US005944542A

United States Patent [19]

Lee

[11] Patent Number: 5,944,542

[45] Date of Patent: Aug. 31, 1999

[54] PLUG SAFETY ADAPTER FOR ANTI-ELECTRIC SHOCK

[75] Inventor: Han Young Lee, Garland, Tex.

[73] Assignee: Han Y. Lee, Garland, Tex.

[21] Appl. No.: 08/883,798

[22] Filed: Jun. 27, 1997

[51] Int. Cl.[6] ..... H01R 13/44

[52] U.S. Cl. ..... 439/140; 439/915

[58] Field of Search ..... 439/140, 139, 439/915

[56] References Cited

U.S. PATENT DOCUMENTS

| | | | |
|---|---|---|---|
| 3,317,881 | 5/1967 | Setecka | 439/140 |
| 3,775,729 | 11/1973 | Casper | 439/459 |
| 4,340,267 | 7/1982 | Nukaga | 439/141 |
| 4,445,739 | 5/1984 | Wooten | 439/140 |
| 5,140,659 | 8/1992 | Minds et al. | 439/140 |
| 5,281,156 | 1/1994 | Yi | 439/137 |
| 5,423,689 | 6/1995 | Valentino | 439/141 |

*Primary Examiner*—Neil Abrams
*Assistant Examiner*—T. C. Patel
*Attorney, Agent, or Firm*—Mark W. Handley

[57] ABSTRACT

A plug safety adapter is provided for preventing electric shock from occurring while handling an electric plug. The plug safety adapter is comprised of a cylindrical housing, a face plate and a spring which extends between the cylindrical housing and the face plate for applying a biasing force therebetween. The face plate and the spring are positioned inside the cylindrical housing, such that the face plate is moveable within the housing against the biasing force of the spring. The face plate has holes of the same size as those of the prongs of the electric plug for receiving the prongs, such that the face plate is secured to the electric plug and moves backward and forward with the electric plug. As the plug is pushed into an electrical outlet, the housing will push rearward of the prongs of the electric plug and rearward of the face plate. The forward end of the face plate will fit substantially flush with the lowermost end of the housing when the electric plug is fully inserted into the electrical outlet. When the electric plug is removed from the electrical outlet, the housing will move forward to extend forward of the face plate and around the prongs of the electric plug. The prongs are constantly shielded by the housing as the electric plug is being pushed into and then later removed from an electrical outlet.

19 Claims, 1 Drawing Sheet

PLUG SAFETY ADAPTER FOR ANTI-ELECTRIC SHOCK

CROSS REFERENCE TO RELATED APPLICATION

The present application claims priority to U.S. patent application Ser. No. 08/719,330, filed on Sep. 25, 1996, and entitled "PLUG SAFETY ADAPTER FOR ANTI-ELECTRIC SHOCK."

TECHNICAL FIELD OF THE INVENTION

The current invention relates to devices for preventing electric shock caused by accidental contact with the prongs of electric plug connectors used for plugging into electrical outlets.

BACKGROUND OF THE INVENTION

The prior art contains a number of anti-electric shock safety devices for use with electric plugs which are removably coupled to electrical outlets. These anti-electric shock safety devices utilize configurations which prevent the prongs of electric plugs from being exposed when they are plugged into or removed from an electrical outlet. Some prior art anti-electric shock safety devices require that the existing electrical outlets be replaced with specially designed outlets. Other anti-electric shock safety devices require the replacement of existing electric plugs with electric plugs which include the anti-electric shock safety device, calling for retrofitting of existing electrical cords. Still other anti-electric shock safety devices leave openings in which persons, such as children, may insert a bare wire, a thin piece of metal or a finger and contact the electric prongs of a plug when the prongs are partially plugged into an electrical outlet. Also, prior art anti-electric shock safety devices typically have high manufacturing and replacement costs, such that the anti-electric shock safety devices are too expensive for ready acceptance by consumers.

SUMMARY OF THE INVENTION

The present invention disclosed and claimed herein is directed toward an electric plug safety adapter which includes a hollow tubular housing, a face plate having holes for receiving the prongs of an electric plug, and a spring. The face plate is moveably mounted within the housing, with the spring extending therebetween to bias the housing such that the housing extends forward of the face plate and toward an electrical outlet when the adapter is mounted to an electric plug. The prongs of the electric plug are inserted through the holes of the face plate to mount the plug safety adapter to the housing, with a snug fit between the face plate holes and the prongs such that the plug safety adapter will remain secured to the electric plug during normal use. The rear side of the face plate contacts the tip of the electrical plug case, with the housing being biased by the spring such that the housing extends forward of the face plate, fully enclosing the prongs of the electric plug therein.

Once the plug safety adapter is mounted to the electric plug, the electric plug is placed adjacent to an electrical outlet and then plugged into the electrical outlet in normal fashion, as it would be done if the plug safety adapter were not mounted to the electric plug. As the prongs of the electric plug are inserted into the sockets of the electrical outlet, the housing extends around the prongs, covering the prongs as they are inserted into the sockets. The housing will move rearward over the prongs and the face plate until the lowermost end of the housing is flush with the forward end of the face plate. As the electric plug is removed from the electrical outlet, the bias spring will cause the housing to move forward over the face plate and to extend around the prongs of the electric plug. The housing, in combination with the cover plate of the electrical outlet, fully encloses the prongs of the electric plug until they are fully removed from the socket of the electrical outlet to prevent persons from contacting the prongs.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
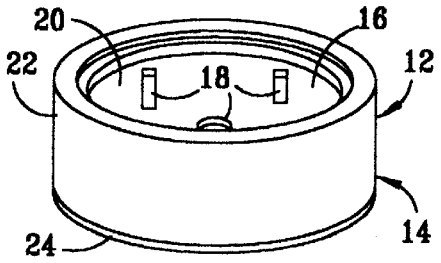
FIG. 1 illustrates a perspective view of a plug safety adapter made according to the present invention.

Referring now to FIG. 1, there is illustrated a perspective view of a plug safety adapter 12 made according to the present invention. The plug safety adapter 12 is shown prior to being mounted to an electric plug of the type for mating with an electrical outlet. The plug safety adapter 12 has an outer housing 14, and a face plate 16 which is moveably mounted to the housing 14. Three prong holes 18 extend through a recessed, inner portion 20 of the face plate 16 for receiving the prongs of an electric plug. The housing 14 includes a rigid cylindrical case 22 and a bottom ring 24.

Figure 2:
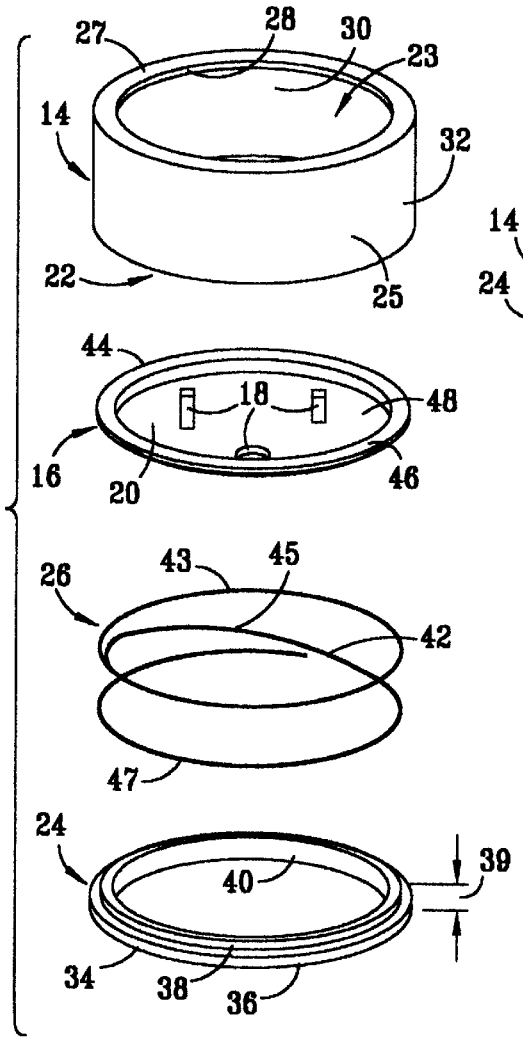
FIG. 2 illustrates an exploded view of the plug safety adapter.

Referring now to FIG. 2, there is illustrated an exploded view of the plug safety adapter 12. The plug safety adapter 12 includes the case 22, the face plate 16, a spring 26 and the bottom ring 24. The case 22, the face plate 16 and the bottom ring 24 are made of rigid plastic materials, such that they substantially will maintain their shapes under normal working conditions. The case 22 of the housing 14 is hollow, having a tubular shape which defines a tubular passage 23. The cylindrical case 22 further has an exterior wall 25 and an overhang ridge 27 which is disposed at the top end thereof, and formed as one piece with the cylindrical case 22. The ridge 27 extends inward from the exterior wall 25 and forms a circular opening 28 at the top of the case 22 which has a smaller diameter than the inner diameter of the interior surface 30 defining the tubular passage 23 of the case 22. The outer surface 32 of the case 22 is preferably cylindrical.

A lowermost end 34 of the housing 14 is defined by the bottom ring 24. The bottom ring 24 is a two-step circular ring having an L shaped-cross section 35 as viewed in the sectional views of FIGS. 3–8. The bottom ring 24 has three vertical surfaces 36, 38 and 40 of different sizes of diameters. The vertical surface 36 forms an outer edge surface of the bottom ring 24 and has the largest diameter, and is the same size as the outer surface 32 of case 22 of the housing 14. The intermediate surface 38 has the second largest diameter, and is similar in size to the inner surface 30 of the case 22, such that the intermediate surface 38 fits very tightly into the inner surface 30 to provide a press fit therebetween to retain the bottom ring 24 in position within the case 22 once it is installed into the bottom of the case 22. The interior surface 40 is preferably cylindrical in shape and provides the lowermost opening of the bottom side 34 of the housing 14. The interior surface 40 is sized for freely receiving the inner portion 20 of the face plate 16, such that the face plate 16 may fit flush with the lowermost edge 34 of the housing 14 and the bottom ring 24. The bottom ring 24 has an axial thickness 39, such that a standard sized prong of a standard sized electric plug will extend far enough through the face plate 16 to fully engage within standard sized sockets of a standard electrical outlet.

The spring 26 has an elasticity which is functional after having been pressed for a long period of time. The spring 26 also is selected to have a strength for easy compression during use and to hold the housing 14 in position such that it extends around the exterior of the prongs 52 of the electric plug 50 (shown in FIG. 3) when the plug safety adapter 12 is mounted to the electric plug 50 and the electric plug 50 is not plugged into an electrical outlet. The spring 26 is made of spring steel which is formed into a circular and spiral shape. The spring 26 is preferably tapered in a longitudinal direction such that the adjacent ones of the spring coils 42 may fit within each other when the spring 26 is collapsed in a longitudinal direction. Three (3) coils are depicted for spring 26. An upper coil 43 defines an upper circular ring, a center coil 45 provides resiliency for the spring 26, and a lower coil 47 defines a lower circular ring. The upper coil 43 is smaller in diameter than the center coil 45, which is smaller in diameter than the lower coil 47, such those of the coils 42, 43 and 45 which are smaller than adjacent ones of the coils 42, 43 and 45 will fit within the adjacent ones of the coils 42, 43 and 45 in lateral alignment when the spring 26 is longitudinally collapsed. That is, adjacent ones of the coils 42, 43 and 45 will fit within one another in a lateral alignment when the spring 26 is compressed.

The face plate 16 is a two-step flat disk with an outer diameter 44 which is smaller in diameter than the inner diameter of the inner surface 30 of the cylindrical case 22 of the housing 14, but is larger than the diameter of the opening 28 of the top ridge 27 of the case 22. An annular surface 46 extends radially outward around an inner surface 48 of the recessed portion 20 to define a narrow rim area. The inner surface 48 is recessed from the annular surface 46. The recessed, inner face surface 48 has three holes 18 which extend through the inner surface 48, which are of the same size as the prongs 52 of the common type of electric plug 50 (shown in FIG. 3). The holes 18 are sized to provide a snug, press fit with the prongs 52 for retaining the plug safety adapter 12 about the electric plug 50 during use, yet large enough such that the prongs 52 may easily be inserted into the holes 18. The face plate 16 is preferably one-thirty second (1/32) inches thick.

Figure 3:
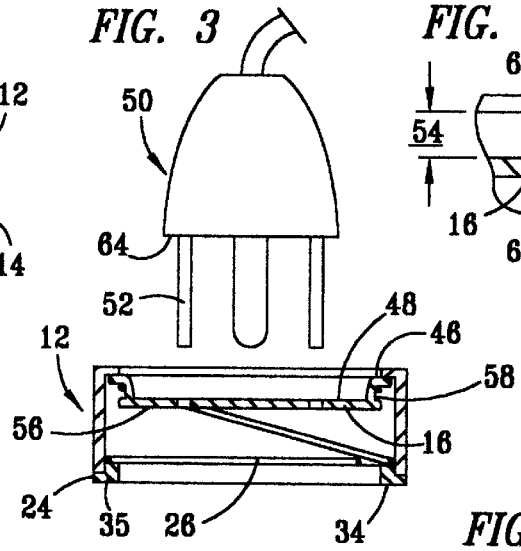
FIG. 3 illustrates an electric plug and a sectional view of the plug safety adapter immediately prior to mounting the plug safety adapter to the electric plug.

Referring now to FIG. 3, there is illustrated a sectional view of the plug safety adapter 12 immediately prior to being mounted to a three prong electric plug 50. The recess between the surfaces 46 and 48 of the face plate 16 is depicted, with the annular surface 46 being spaced apart from the inner surface 48 by an axial spacing 54 (shown in FIG. 6). The spacing 54 preferably has a length of not substantially less than the combined distances of the fully compressed length of the spring 26 and the axial thickness 39 (shown in FIG. 7) of the bottom ring 24. This allows the forward end surface 56 of the face plate 16 to fit substantially flush with the bottom, lowermost surface 34 of the housing 14 when the spring 26 is compressed. The inner surface 48 is thus recessed from the annular area 46, with the annular area 46 extending along the peripheral edge of the face plate 16. The inner surface 48 and the annular area 46 are preferably circular. A retaining groove 58 extends around the outer peripheral edge of the annular surface 46 of the face place 16, and is defined by an upper shoulder 60 and a lower shoulder 62 which extend radially outward from the face plate 16. (shown in FIG. 6) The upper end of the spring 26 is retained within the retaining groove 58. The upper shoulder 60 is defined by the annular surface area 46, and the lower shoulder 62 may be defined by a small protuberance.

Figure 4:
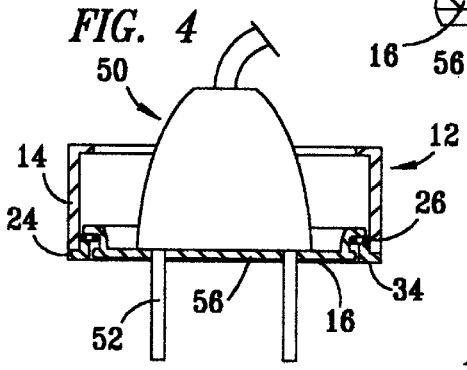
FIG. 4 illustrates the electric plug and a sectional view of the plug safety as they would appear when the plug is fully plugged into an electrical outlet.

FIG. 4 illustrates the plug safety adapter 12 and the electric plug 50, with the electric plug 50 being fully inserted into an electrical outlet (not shown). The forward end surface 56 of the face plate 16 is disposed flush with the lowermost end 34 of the housing 14, which is defined by the bottom ring 24. The spring 26 is fully compressed between the shoulder 60 (shown in FIG. 6) of the face plate 16 and the bottom ring 22.

Figure 5:
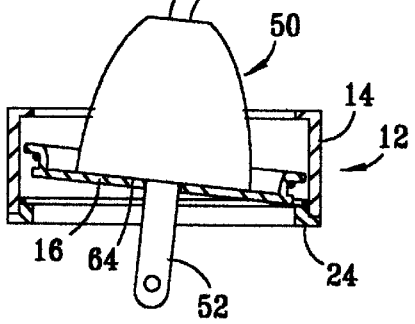
FIG. 5 illustrates the electric plug and a sectional view of the plug safety adapter showing the electric plug in an angled position with respect to the plug safety adapter, such as they may appear when the electric plug is in a partially plugged into an electrical outlet.

FIG. 5 illustrates the plug safety adapter 12 with the electric plug 50 being disposed at an angle thereto, as may occur when partially plugged into an electrical outlet. The face plate 16 still remains in contact with the plug face 64 and moves together with the plug 50.

Figure 6:
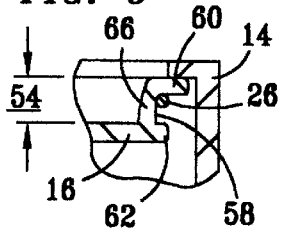
FIG. 6 illustrates a sectional view of a peripheral edge of a face plate and a corner of the housing of the plug safety adapter prior to installing the electric plug into the plug safety adapter.

Referring now to FIG. 6, there is illustrated a sectional view of a peripheral edge 66 of a face plate 16 and an upper corner of the housing 14 of the plug safety adapter 12 prior to installing the electric plug 50 into the plug safety adapter 12. The face plate 16 is disposed at the top end of the housing 14, with the spring 26 engaged within the retaining groove 58 of the face plate 16. The edge groove 58 of the face plate 16 defines a spring engagement member of the face plate 16 for engaging the spring 26.

Figure 7:
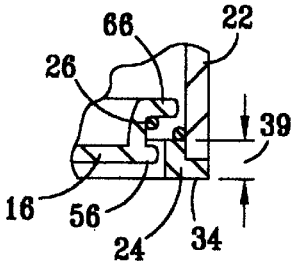
FIG. 7 illustrates a sectional view of the peripheral edge of the face plate and the corner of the housing of the plug safety adapter as they would appear when the plug safety adapter is mounted to an electric plug which is fully plugged into an electrical outlet.

Referring now to FIG. 7, there is illustrated a sectional view of the peripheral edge 66 of the face plate 16 and a lower corner of the housing 14 of the plug safety adapter 12 as they would appear when the plug safety adapter 12 is mounted to an electric plug 50 when the plug 50 is fully plugged into an electrical outlet. The coils 42 of the tapered spring 26 have collapsed such that they are aligned to be disposed laterally adjacent to one another, in a side-by-side relation as opposed to a longitudinal relation of a non-tapering spring. The forward end surface 56 of the face plate 16 is disposed flush with the lowermost end 34 of the housing 14.

Figure 8:
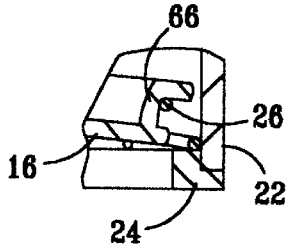
FIG. 8 illustrates a sectional view of the peripheral edge of the face plate and the corner of the housing of the plug safety adapter as they would appear when the plug safety adapter is mounted to an electric plug which is partially plugged into an electrical outlet, and the face plate is angled with respect to the housing of the plug safety adapter.

Referring now to FIG. 8, there is illustrated a sectional view of the peripheral edge 66 of the face plate 16 and the lower corner of the housing 14 of the plug safety adapter 12 as they would appear when the plug safety adapter is mounted to an electric plug which is partially plugged into an electric socket, and the face plate 16 is angled with respect to the housing 14 of the plug safety adapter 12. The tapered coil spring 26 has been partially expanded, such that the coils 48 of the spring 26 are not directly adjacent to one another in a laterally disposed, side-by-side relation.

In operation, the electric plug 50 is pushed into the holes 18 of the face plate 16, and the prongs 52 go through easily and yet the fit is snug enough such that the plug safety adapter 12 will remain secured to the prongs 52 of the electric plug 50 during normal use. The electric plug 50 and the plug safety adapter 12 are then placed adjacent to an electrical outlet and simply pushed further against the electrical outlet to plug in the electric plug 50 into the electrical outlet. As the electric plug 50 is pushed into the electrical outlet, the face plate 16 moves together with the electric plug 50, with the face plate 16 closely contacting the forward end of the electric plug 50 as the spring 26 is compressed. This allows the electric prongs 52 to move into and out of the electrical outlet without exposing the electric prongs 52 to the outside of the housing 14. The forward end surface 56 of the face plate 16 then fits flush with the lowermost end 34 of the housing 14, such that there will not be a large separation distance between the bottom face 64 of the plug housing and the outside face of a cover for the electrical outlet. The face plate 16 is also preferably selected to be formed of relatively thin member of non-conductive material, preferably no more than one-thirty-seconds (1/32) inches.

As the electric plug 50 is removed from the electrical outlet, the face plate 16 moves together with the electric plug 50, with the face plate 16 closely contacting the end face 64 of the plug 50 as the spring 26 is released from being compressed. The spring 26 biases housing 14 to move forward over the electric prongs 52 as the plug 50 is removed from the electrical outlet, covering the prongs 52 such that they remain enclosed within the housing 14. The plug safety adapter 12 remains mounted to the electric plug 50 when the plug 50 is pulled from the electrical outlet. The plug safety adapter 12 can be removed by hand at any time simply by removing the prongs 52 of the electric plug 50 from engaging within the holes 18 of the face plate 16.

In other embodiments of the present invention, the distance between the recess of an inner surface of the face plate and a spring retention member, or spring engagement member, may be selected for providing an axial spacing for a plug safety adapter having a non-tapered coil spring. Then the axial spacing is preferably selected such that the retention member is spaced apart from the inner surface of the face plate by a large enough distance for accommodating a non-tapered coil spring so that the forward end of the face plate will fit substantially flush with the lowermost end of the housing of the plug safety adapter. This allows the plug safety adapter to be used with standard length prongs of a standard electric plug, such that the prongs may still fully engage within the sockets of a standard sized electrical outlet, without requiring retrofitting of either the plugs or the electrical outlet for use with the plug safety adapter.

The plug safety adapter of the present invention provides several advantages over prior art anti-electric shock safety devices. The plug safety adapter of the present invention protects persons, including small children, from accidental electric shock while the electric plug is being inserted into or pulled out of an electric outlet by preventing a person from contacting the prongs of the plug. The housing extends around the prongs as it is removed from the electrical outlet to fully enclose the prongs within the housing until it is fully removed from the electric plug. The face plate is movable together with the electric plug within the housing against the force of the spring while the housing provides a constant cover for the electric prongs. The current invention is also very easy to use, and may remain mounted to the electric plug or may be easily removed for use with another electric plug. Additionally, the manufacturing costs are also considered to be at a minimum due to the simple design and the relatively few components utilized therein.

Although the preferred embodiment has been described in detail, it should be understood that various changes, substitutions and alterations can be made therein without departing from the spirit and scope of the invention as defined by the appended claims.

What is claimed is:

1. A plug safety adapter for preventing an electric shock to a person engaging an electric plug with an electrical outlet, comprising:

a housing having a length for extending over the prongs of the electric plug;

a face plate moveably disposed within the housing, the face plate having at least one hole for receiving at least one of the prongs of the electric plug, and a thickness such that the prongs of the electric plug extend through the face plate and from a forward side of the said face plate for engaging within the electrical outlet;

a spring extending between said housing and said face plate for urging said housing to extend forward of said face plate and around the prongs of the electric plug, such that the prongs are disposed within said housing when the prongs are removed from engaging within the electrical outlet; and wherein a lowermost end of said housing fits substantially flush with said forward side of said face plate when the prongs of the plug are extending through the said face plate and are fully engaged within the socket of the electrical outlet.

2. The plug safety adapter of claim 1, wherein said face plate has an outer peripheral portion and a recessed inner portion through which the prongs of the plug extend, with said outer peripheral portion and said recessed inner portion being spaced apart for accommodating a length of said spring when said lowermost end of said housing is fitting substantially flush with said forward side of said face plate.

3. The plug safety adapter of claim 1, wherein said spring is a coil spring which is tapered in a longitudinal direction, such that coils of said spring will fit within adjacent ones of said coils when said spring is compressed for fitting said lowermost end of said housing substantially flush with said forward side of said face plate.

4. The plug safety adapter of claim 1, wherein said spring is secured at a first end of said lowermost end of said housing and secured at a second end to said face plate.

5. The plug safety adapter of claim 1, further comprising:

said housing having an upper ridge which extends inward from an exterior wall of said housing for retaining said face plate within an upper end of said housing;

a retaining ring which defines said lowermost end of said housing, said retaining ring extending inwardly from said exterior wall of said housing for retaining said face plate within said lowermost end of said housing; and said spring extending between said face plate and said retaining ring for urging said housing to extend forward of said forward side of said face plate.

6. The plug safety adapter of claim 5, further comprising a spring retaining member which extends laterally outward from said face plate for fixedly securing said spring to said face plate.

7. The plug safety adapter of claim 6, wherein said spring retaining member comprises a groove formed into a peripheral edge of said face plate.

8. The plug safety adapter of claim 6, wherein said spring retaining member comprises a protuberance which extends laterally outward from said face plate for engaging an end of said spring.

9. A plug safety adapter for preventing an electric shock to a person engaging an electric plug with an electrical outlet socket, comprising:

a housing having an interior passage of a length for extending over the prongs of the electric plug;

a face plate moveably disposed within said interior passage of said housing, said face plate having a plurality of holes for receiving the prongs of the electric plug, and a thickness such that the prongs of the electric plug extend through the face plate and from a forward side of said face plate for engaging within the electrical outlet socket;

a spring extending between said housing and said face plate for urging said housing to extend forward of said face plate and around the prongs of the electric plug, such that said housing will extend over the prongs when the prongs are removed from engaging within the electric outlet socket;

wherein a lowermost end of said housing fits substantially flush with said forward side of said face plate when the prongs of the plug are extending through said face plate and are fully engaged within the electrical outlet socket; and wherein said face plate has an outer peripheral portion and a recessed inner portion through which the prongs of the plug extend, with said outer peripheral portion and said recessed inner portion being spaced apart for accommodating a length of the spring when said lowermost end of said housing is fitting substantially flush with said forward side of said face plate.

10. The plug safety adapter of claim 9, wherein said spring is a coil spring which is tapered in a longitudinal direction, such that coils of said spring will fit within adjacent ones of said coils when said spring is compressed for fitting said lowermost end of said housing substantially flush with said forward side of said face plate.

11. The plug safety adapter of claim 9, further comprising:

said housing having an exterior wall and an upper ridge which extends inward from said exterior wall of said housing and into said interior passage for retaining said face plate within said interior passage of said housing;

a retaining ring which defines said lowermost end of said housing, said retaining ring extending inwardly from said exterior wall of said housing for retaining said face plate within a lowermost end of said interior passage of said housing; and said spring extending between said face plate and said retaining ring for urging said housing to extend forward of said forward side of said face plate.

12. The plug safety adapter of claim 9, further comprising a spring retaining member which extends laterally outward from said face plate for fixedly securing said spring to said face plate.

13. The plug safety adapter of claim 12, wherein said spring retaining member comprises a groove formed into a peripheral edge of said face plate.

14. The plug safety adapter of claim 12, wherein said spring retaining member comprises a protuberance which extends laterally outward from said face plate for engaging an end of said spring.

15. A plug safety adapter for preventing an electric shock to a person engaging an electric plug with an electrical outlet socket, comprising:

a rigid housing defining a hallow cylindrical case having an inner diameter and an inwardly projecting overhang ridge at a top end thereof, said overhang ridge forming a top circular opening which has a smaller diameter than said inner diameter of said cylindrical case;

a bottom ring having first and second portions of different outer diameters which define spaced apart and parallel stepped surfaces and an L-shaped section thereof, one of said outer diameters sized for tightly fitting said first portion within said inner diameter of said cylindrical case, and another of said outer diameters sized such that one of said stepped surfaces extends inwardly therefrom for engaging against a bottom edge of said cylindrical case;

a face plate having a peripheral edge with a diameter for movably fitting within said inner diameter of said cylindrical case in concentric alignment therewith, and said peripheral edge being larger than said top circular opening of said cylindrical case for retaining said face plate therein;

said face plate having a recessed portion of a thickness and having a plurality of holes for receiving prongs of the electric plug and passing the prongs of the electric plug therethrough, such that the prongs of the electric plug will extend through said face plate for directly engaging within the electrical outlet socket;

said recessed portion of said face plate having an outer peripheral edge of a diameter which moveably passing interiorly within said first portion of said bottom ring for fitting flush with the lower end thereof when the prongs of the electric plug are engaged within the electrical outlet socket; and a spring of a circular and spiral shape disposed within said cylindrical case, with one end of said spring engaging against a second one of said stepped surfaces defined by said first portion of said bottom ring, and on the other end of said spring secured to said face plate for urging said cylindrical case downward relative to said face plate, such that said cylindrical case extends exteriorly around the prongs of the electric plug when the prongs are removed from the electrical outlet socket, with a length of said hallow cylindrical case being longer than a length of the prongs of the electric plug.

16. The plug safety adapter of claim 15, wherein said spring extends exteriorly around the prongs of the electrical plug when the electrical plug is engaged with said face plate.

17. The plug safety adapter of claim 15, wherein said spring is a coil spring which is tapered in a longitudinal direction, such that coils of said spring will fit within adjacent ones of said coils when said spring is compressed for fitting a lowermost end of said housing substantially flush with a forward side of said face plate.

18. The plug safety adapter of claim 15, wherein said spring is a coil spring which is tapered in a longitudinal direction, such that coils of said spring will fit within adjacent ones of said coils when said spring is compressed for fitting a lowermost end of said housing substantially flush with a forward side of said face plate; and wherein said spring extends exteriorly around the prongs of the electrical plug when said electrical plug is engaged with said face plate.

19. The plug safety adapter of claim 15, wherein said spring extends exteriorly around the prongs of the electrical plug when the electrical plug is engaged with said face plate, and a lowermost end of said housing fits substantially flush with a forward side of said face plate when the prongs of the plug are fully engaged within the socket of the electrical outlet.

* * * * *